United States Patent [19]

Kendrick

[11] Patent Number: 4,657,155

[45] Date of Patent: Apr. 14, 1987

[54] LID SUPPORT ROD

[76] Inventor: Billy J. Kendrick, 1104 Rice Ct., Arlington, Tex. 76012

[21] Appl. No.: 853,933

[22] Filed: Apr. 21, 1986

[51] Int. Cl.[4] ..... F24B 3/00

[52] U.S. Cl. ..... 217/60 B; 217/60 C; 217/60 D

[58] Field of Search ..... 217/60 R, 60 B, 60 C, 217/60 D; 220/332, 335, 85 CH

[56] References Cited

U.S. PATENT DOCUMENTS

| | | | |
|---|---|---|---|
| 1,324,094 | 12/1919 | Zega | 217/60 D |
| 2,035,944 | 3/1936 | Browne | 217/60 D |
| 2,760,806 | 8/1956 | Woodard et al. | 217/60 C X |
| 3,225,856 | 12/1965 | Caramanna | 217/60 B X |

FOREIGN PATENT DOCUMENTS

| | | | |
|---|---|---|---|
| 327914 | 4/1930 | United Kingdom | 217/60 C |

*Primary Examiner*—Steven M. Pollard

*Attorney, Agent, or Firm*—Glaser, Griggs & Schwartz

[57] ABSTRACT

A lid support rod for holding open the lid of a storage container is comprised of a first plate member, second and third plate members and a central pin member disposed between the first plate member and the second and third plate members. The second plate member is pivotally mounted on the pin member so as to be rotatable about the axis thereof and cooperates with the stationary first plate member to form a hinge. An elongated support rod is pivotally attached at one end thereof to the second plate member and is free to rotate relative to the second plate member so that the rod has three degrees of freedom of movement to engage the container lid at essentially any desired position thereon.

5 Claims, 4 Drawing Figures

LID SUPPORT ROD

FIELD OF THE INVENTION

The present invention relates generally to mechanical support devices and in particular to a support device for holding open the lid of a container or the like.

BACKGROUND OF THE INVENTION

Lids for storage containers and the like are often hinged to allow the lid to be rotated from a horizontal or "closed" position through an arc greater than 90 degrees to stabilize the lid in an "opened" position. When the container is located in a confined area, such as in a boat, the lid may be constrained from rotating more than 90 degrees (i.e., past the vertical position). Thus, some other means of support must be provided to hold the lid open in such circumstances.

DESCRIPTION OF THE PRIOR ART

According to prior practice, storage containers are often equipped with a mechanism for holding open the container lid in a fixed position. Such mechanisms include devices for locking the hinges in a predetermined position and elongated braces or the like to prop open the lid. Such braces are typically affixed at one end thereof to a side of the container opposite from the side thereof at which the lid is attached and the opposite end of the brace is free to rotate upwardly from a horizontal position to engage the lid.

One limitation of conventional support braces is that the brace member is constrained to move in a single plane so that the brace member has only two degrees of freedom. Thus, the brace can only engage the lid at certain positions thereon commensurate with the degree of freedom of movement of the brace.

OBJECTS OF THE INVENTION

It is, therefore, the principal object of the present invention to provide an improved support mechanism for a container lid.

Another object of the invention is to provide an improved support rod for holding open the lid of a container.

Still another object of the invention is to provide a support rod for a storage container in which the rod has three degrees of freedom to engage the lid at any desired location thereon.

SUMMARY OF THE INVENTION

These and other objects are accomplished in accordance with the present invention wherein a support device for holding open the lid of a container is comprised of hinge means having first and second plate members and a central pin member disposed between the first and second plate members. The second plate member is pivotally mounted on the central pin member so that the second plate member is rotatable about the axis of the pin member. The device further includes an elongated rod pivotally attached at one end thereof to the second plate member. The rod is rotatable about a vertical axis which is orthogonal with respect to a major surface of the second plate member so that the rod has three degrees of freedom of movement to engage the container lid at any desired position thereon.

In one embodiment the support device further includes a third relatively flat plate member coupled to the pin member and disposed substantially orthogonal with respect to the first plate member. A base member is attached to a major surface of the third plate member. The base member has an extension portion extending horizontally beyond an end of the third plate member in the direction of the second plate member for engaging the second plate member to limit the travel thereof.

In yet another embodiment the second plate member includes a projection member extending vertically upward therefrom and a spring member overlying a portion of the third plate member adjacent to the projection member. The projection member has a notch on an upper edge thereof for receiving the rod when the rod is not in engagement with the container lid. The spring member exerts downward biasing pressure on the rod to hold it securely within the notch.

In the preferred embodiment the support device is attached to the container by mounting the first plate member at a predetermined location on an inner wall of the container, opposite from the container wall to which the lid is attached. The first plate member includes a plurality of openings through which a bolt or rivet may be inserted to attach the support device to the container. The second plate member is positioned with respect to the third plate member so that the second and third plate members are substantially in edge to edge abutting relationship at respective facing ends thereof and lie substantially in the same plane when the second plate member is in engagement with the extension portion of the base member. The lid engaging end of the rod preferably includes a rubber tip which is somewhat broader than the diameter of the rod to provide stable contact between the rod and the lid. The plate members, base member and rod are preferably comprised of a lightweight metal material.

BRIEF DESCRIPTION OF THE DRAWINGS

Other objects and advantages of the invention will be apparent from the detailed description and claims when read in conjunction with the accompanying drawings wherein:

FIG. 2 is a perspective view of the lid support rod according to the present invention, showing the rod in position to engage the lid of a storage container or the like;

DETAILED DESCRIPTION OF THE PREFERRED EMBODIMENT

In the description which follows, like parts are marked throughout the specification and drawings respectively. The drawings are not necessarily to scale and in some instances proportions have been exaggerated in order to more clearly depict certain features of the invention.

Figure 1:
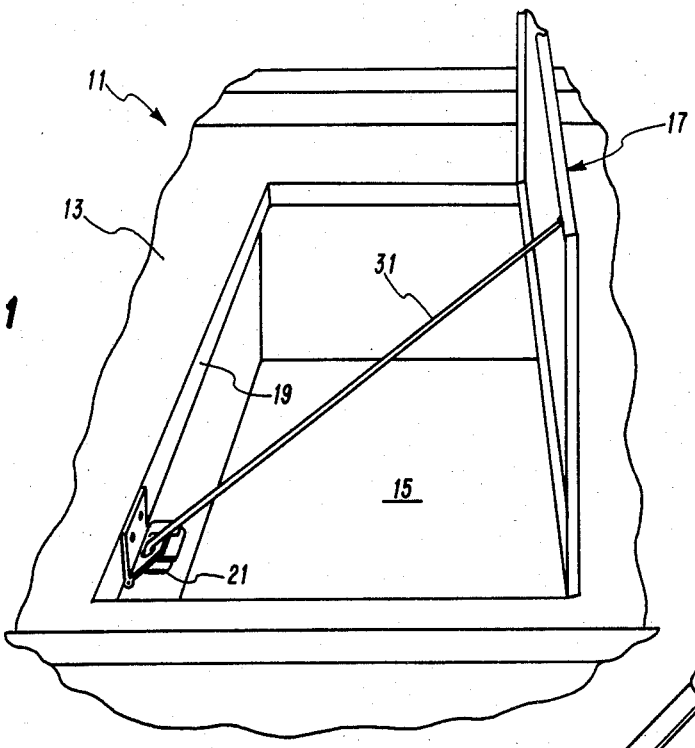
FIG. 1 is a perspective view of a storage container showing the support rod according to the present invention engaging the lid of a container.
Figure 2:
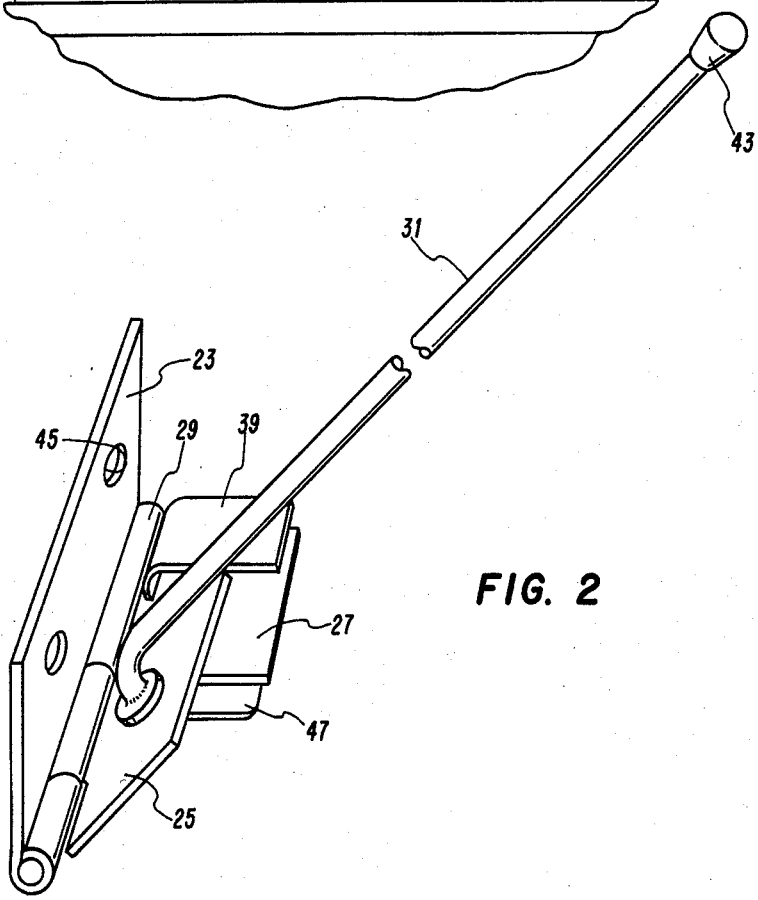
Figure 3:
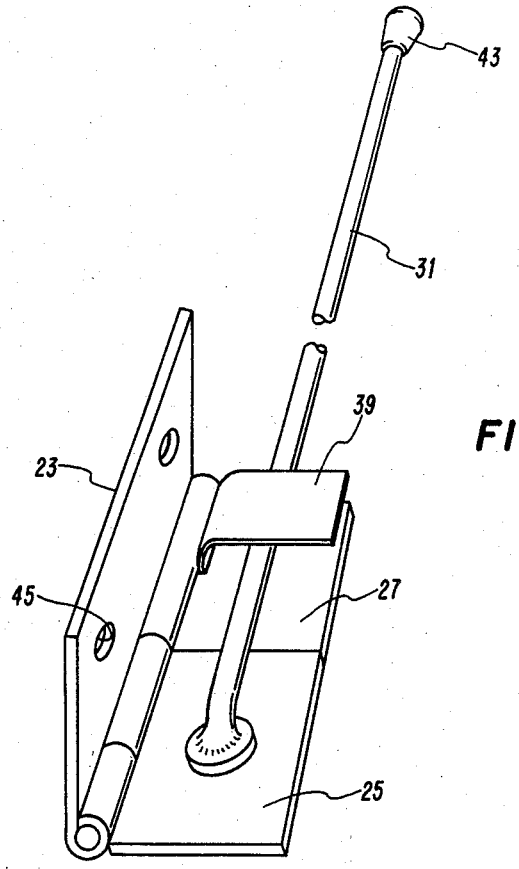
FIG. 3 is a perspective view of the lid support rod according to the present invention, showing the rod secured in a non-operative position.

Referring to FIGS. 1, 2 and 3, a storage container 11 is comprised of a housing 13, a central opening 15 in the housing and a lid 17, which is pivotally attached to housing 13 along one edge thereof. In FIG. 1, container 11 is depicted as a rectangular-shaped container for illustration purposes only. Any size or shape of container may be used in conjunction with the present invention. Container 11 may be of the portable type or, alternatively, as illustrated in FIG. 1, may be permanently inset below a major surface, such as the deck of a boat.

Attached on an inner wall 19 of container 11, opposite from the wall to which lid 17 is attached, is lid support device 21 according to the present invention. Device 21 is comprised of a first relatively flat plate member 23 and second and third plate members 25 and 27. Disposed between first plate member 23 and second and third plate members 25 and 27 is a central pin member 29. Plate members 23, 25 and 27 and pin member 29 cooperate to in effect form a hinge. First plate member 23 and third plate member 27 are fixedly attached to pin member 29 so as not to be rotatable with respect thereto. Second plate member 25 is pivotally mounted with respect to pin member 29 and is free to rotate with respect to pin member 29 and plate members 23 and 27 within limits, as will be described hereinbelow.

An elongated rod 31 is pivotally attached to the central portion of second plate member 25 so that rod 31 is rotatable about an axis which is perpendicular to the major surfaces of second pin member 25. One skilled in the art will readily see that the hinge effect produced by the rotation of second plate member 25 with respect to central pin member 29 and the rotation of support rod 31 with respect to second plate member 25 allows support rod 31 to have freedom of movement in all three directions.

Figure 4:
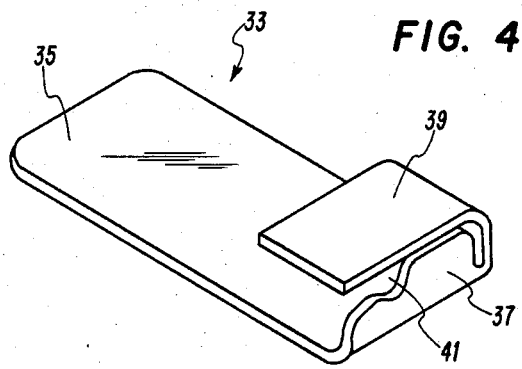
FIG. 4 is a perspective view of a portion of the lid support device of the present invention, which is used to retain the support rod in a non-operative position.

Attached to third plate member 27, preferably by spot welding, is a base member 33. Base member 33 is depicted in greater detail in FIG. 4. Base member 33 includes an elongated member 35, a projection member 37 extending vertically upward from member 35 at a first end thereof and a spring member 39, which overlaps a portion of member 35 adjacent to projection member 37. Member 35, projection member 37 and spring member 39 are preferably integrally formed as a single metal piece. Projection member 37 has a notch 41 disposed in an upper edge thereof for retaining support rod 31 in a secure position for storage when rod 31 is not in engagement with lid 17 of container 11, as depicted in FIG. 3. When support rod 31 is received within notch 41, spring member 39 exerts downward pressure on rod 31 to hold it securely within notch 41. When it is desired to remove rod 31 from the aforementioned non-operative position, the user need only exert a slight upward force to overcome the spring bias of spring member 39 to free support rod 31 from notch 41 and pivot rod 31 outwardly from beneath spring member 39.

Support device 21 is preferably comprised of a relatively lightweight metal material such as a steel or aluminum alloy or the like. Disposed on the free end of support rod 31 opposite from the end which is attached to second plate member 25 is a rubber tip member 43, which is flared slightly to provide a wider surface for more stable engagement with lid 17. By rotating second plate member 25 with respect to central pin member 29 and support rod 31 with respect to plate member 25, support rod 31 may be positioned to engage lid 17 at any desired position thereon consistent with the position on inner wall 19 at which device 21 is mounted. First plate member 23 includes a plurality of openings 45 for receiving a bolt, rivet or other suitable attachment mechanism, to mount support device 21 at a desired position on inner wall 19 of container 11. The actual location at which support device 21 is mounted on container 11 may be changed to suit the needs of the user. Second plate member 25 is constrained in its rotation with respect to central pin member 29 by first plate member 23 and extension portion 47, which limit the travel of second plate member 25 at the upper and lower limits of travel, respectively, of second plate member 25.

The lid support device according to the present invention has a capability of being used in conjunction with virtually any type of storage container. The portability feature of the support device allows the device to be removed from one container and used in another container if necessary. The flexibility afforded by the three degrees of movement of the support rod allows the support device to be used in conjunction with containers of various sizes and shapes and allows the support rod to engage the container lid at any desired position thereon, consistent with the location on the container at which the first plate member is mounted.

Various embodiments of the invention have been described in detail. Since changes in and modifications to the above-described preferred embodiment may be made without departing from the nature, spirit and scope of the invention, the invention is not to be limited to said details, except as set forth in the appended claims.

What is claimed is:

1. A support device for holding open the lid of a container, comprising:

hinge means having first and second plate members and a central pin member disposed between the first and second plate members, said second plate member being pivotally mounted on said central pin member so that said second plate member is rotatable about the axis of said pin member;

an elongated rod pivotally attached at one end thereof to said second plate member, said rod being rotatable about a vertical axis which is orthogonal with respect to a major surface of said second plate member so that said rod has three degrees of freedom of movement to engage the container lid at essentially any desired position thereon; and, a third relatively flat plate member coupled to said central pin member and disposed substantially orthogonal with respect to said first plate member and a base member attached to a major surface of the third plate member, said base member having an extension portion extending horizontally beyond an end of said third plate member in the direction of said second plate member for engaging said second member to limit the travel thereof in one direction.

2. The support device according to claim 1 wherein said third plate member includes a projection member extending vertically upward therefrom and a spring member overlying a portion of the third plate member adjacent to said projection member, said projection member having a notch on an upper edge thereof for receiving the rod when the rod is not in engagement with a container lid, said spring member exerting biasing pressure on said rod to hold said rod securely within said notch when said rod is engaged by said projection member.

3. The support device according to claim 1 wherein said second plate member is substantially in edge to edge abutting relationship with said third plate member when said extension member engages said second plate member to limit the travel thereof.

4. A storage container having a movable lid and a support device for holding open the lid of the container, said support device comprising:

hinge means having first and second plate members and a central pin member disposed between the first and second plate members, said second plate member being pivotally mounted on said central pin member so that said second plate member is rotatable about the axis of said pin member;

an elongated rod pivotally attached at one end thereof to said second plate member, said rod being rotatable about a vertical axis which is orthogonal with respect to a major surface of said second plate member so that said rod has three degrees of freedom of movement to engage the desired position thereon; and, a third relatively flat plate member coupled to said pin member and disposed substantially orthogonal with respect to said first plate member and a base member attached to a major surface of the third plate member, said base member having an extension portion extending horizontally beyond an end of a third plate member in the direction of said second plate member for engaging the second plate member to limit the travel thereof in one direction.

5. The container according to claim 4 wherein said third plate member includes a projection member extending vertically upward therefrom and a spring member overlying a portion of the third plate member adjacent to said projection member, said projection member having a notch in an upper edge thereof for receiving the rod when the rod is not in engagement with the container lid, said spring member exerting biasing pressure on said rod to hold said rod securely within said notch when said rod is engaged by said projection member.

* * * * *